US007887304B2

(12) United States Patent
Cai et al.

(10) Patent No.: US 7,887,304 B2
(45) Date of Patent: Feb. 15, 2011

(54) METHOD AND STRUCTURE OF PREVENTING WATER FROM LEAKAGE FOR THE PRESSURIZED PUMP OF DIAPHRAGM TYPE

(76) Inventors: Ying Lin Cai, 402, No. 6, Yeong Feng Chih Street, Rong Chi Town, Shunde County, Guangdong (CN); Chao Fou Hsu, 9Fl., No. 16, Lane 417, Huangshing Rd., Sanmin Chiu, Kaohsiung (TW) 807

( * ) Notice: Subject to any disclaimer, the term of this patent is extended or adjusted under 35 U.S.C. 154(b) by 978 days.

(21) Appl. No.: 11/592,977

(22) Filed: Nov. 6, 2006

(65) Prior Publication Data

US 2007/0101860 A1 May 10, 2007

(30) Foreign Application Priority Data

Nov. 8, 2005 (CN) ..... 2005 2 0052387
Apr. 30, 2006 (CN) ..... 2006 2 0050847

(51) Int. Cl.
*F04B 27/08* (2006.01)
*F04B 27/12* (2006.01)

(52) U.S. Cl. ..... 417/271; 417/413.1; 92/100

(58) Field of Classification Search ..... 417/413.1, 417/269, 271; 92/96, 100
See application file for complete search history.

(56) References Cited

U.S. PATENT DOCUMENTS 3,354,830 A * 11/1967 Mortara ..... 417/454
4,396,357 A 8/1983 Hartley ..... 417/269
4,610,605 A 9/1986 Hartley ..... 417/269
5,476,367 A 12/1995 Zimmermann et al. ..... 417/307
5,571,000 A 11/1996 Zimmermann et al. ..... 417/707
5,615,597 A 4/1997 Schoenmeyr ..... 92/103.5
5,626,464 A 5/1997 Schoenmeyr et al. ..... 417/269
5,649,812 A 7/1997 Schoenmeyr et al. ..... 417/363
5,706,715 A 1/1998 Schoenmeyr ..... 92/105.5
5,791,882 A 8/1998 Stucker et al. ..... 417/269
5,816,133 A 10/1998 Schoenmeyr ..... 92/128
6,048,183 A 4/2000 Meza ..... 417/569
6,089,838 A 7/2000 Schoenmeyr et al. ..... 417/572
6,299,414 B1 10/2001 Schoenmeyr ..... 417/244
6,604,909 B2 8/2003 Schoenmeyr ..... 417/32
6,840,745 B1 1/2005 Macauley et al. ..... 417/566
6,892,624 B2 5/2005 Schoenmeyr et al. ..... 92/96
7,013,793 B2 * 3/2006 Dang ..... 92/99

* cited by examiner

*Primary Examiner*—Devon C Kramer
*Assistant Examiner*—Patrick Hamo
(74) *Attorney, Agent, or Firm*—Bacon & Thomas, PLLC

(57) ABSTRACT

A diaphragm type pressurized pump comprises a hollow cylinder formed on the top surface of each piston acting region of the diaphragm sheet. A piston head pushing chunk is disposed on the diaphragm sheet such that a ladder hole in the piston head pushing chunk receives the hollow cylinder. A fixing screw is driven via the center of the hollow cylinder into the threaded hole on each wobble plate. As a result of driving the fixing screw, the upper portion of the hollow cylinder expands thereby deforming and filling up the space between the bottom surface of the head of the fixing screw and the top surface of the ladder hole of the piston head pushing chunk, and thus preventing water from leaking and seeping into the motor of the pump.

2 Claims, 12 Drawing Sheets

METHOD AND STRUCTURE OF PREVENTING WATER FROM LEAKAGE FOR THE PRESSURIZED PUMP OF DIAPHRAGM TYPE

FIELD OF THE PRESENT INVENTION

The present invention relates to the pressurized pump of diaphragm type exclusively used in the reverse osmosis purification, particularly for the pressurized pump with diaphragm function to prevent water from leaking into the motor to thoroughly overcome the drawback of shortening the service life in premature defectively damage by electric short circuit due to water leakage seeping into motor, which always happens in the conventional pressurized pump currently.

BACKGROUND OF THE INVENTION

Currently, there are many pressurized pumps of diaphragm type exclusively used in the reverse osmosis purification as disclosed in the U.S. Pat. Nos. 4,396,357, 4,610,605, 5,476,367, 5,571,000, 5,615,597, 5,626,464, 5,649,812, 5,706,715, 5,791,882, 5,816,133, 6,048,183, 6,089,838, 6,299,414, 6,604,909, 6,840,745 and 6,892,624; Their structure is as shown in the FIG. 1 through FIG. 3, which comprising: a motor 10; an upper hood chassis11 at the end of the output shaft (not shown in the figure) of said motor 10, and having some screw bores 12 on the circumference of said upper hood chassis11; some wobble plates 13 driven by the output shaft of said motor 10 to converted into axial reciprocating motion in said upper hood chassis 11; a diaphragm sheet 20 covering on said upper hood chassis11; some piston head pushing chunks 30 disposed on said diaphragm sheet 20; a piston valve body 40 inset in said diaphragm sheet 20 and a pump cover body 50; By means of bolts 2 running through those said screw bores 12 on said upper hood chassis 11 and corresponding perforated holes 51 on said pump cover body 50, all components said above are assembled into a integral whole body (as shown in the FIG. 2).

Wherein, a ring of seal groove raised bar 21 is built on the top of the circumference at said diaphragm sheet 20, and some raised ribs 22 are radial built from its top center to joint with said seal groove raised bar 21, so that some piston acting regions 23 are partitioned by said raised ribs 22 and seal groove raised bar 21; And, a central perforated hole 24 is punched on each said piston acting regions 23 in alignment with the threaded hole 14 of each said wobble plate 13; By mean of each fixing screw 3 running through the internal ladder hole 31 on each said piston head pushing chunk 30 and each said corresponding central perforated hole 24 on each said piston acting region 23, said diaphragm sheet 20 and those said piston head pushing chunks 30 can be screwed on those said threaded holes 14 on said wobble plates 13 (as shown in the FIG. 2);

Moreover, a hemispherical concaved water drain base 41 facing said pump cover body 50 is built in the center of said piston valve body 40 with a positioning hole 42 in its center; a partition indented groove 43 is formed on each 120° included angle along the radial line from its center so that three isolated sectors are separated by these said indented grooves 43; some water drain ports 44 are created on each said isolated sectors, and some water inlet ports 45 are created on the circumference in correspondence with each said water drain port 44; an upside down flare piston sheet 46 is punched in the center of each said water inlet ports 45 so that enable each said flare piston sheet 46 to block each said water inlet ports 45; Said anti-reverse baffle plastics pad 47 which being a soft elastic hollow hemisphere of unitary body with a positioning pole 48 protruding in the bottom center, stays closely against the top surface tightly of said water drain base 41 on said piston valve body 40; a partition rib plate 49 is formed on each 120° included angle along the radial line from its center so that three isolated sectors are separated by these said rib plates 49; a protruding peg 481 is also formed on the outer peripheral surface in correspondence with each said rib plate 49; By means of plugging said positioning pole 48 into said positioning hole 42 on said water drain base 41 together with insetting each said protruding peg 481 into each corresponding said indented groove 43, the outer hemisphere surface of said anti-reverse baffle plastics pad 47 will tightly contact against closely all said water drain ports 44 on each sector of said water drain base 41 (as shown in the FIG. 2); Wherein, a water inlet chamber 100 is formed among said anti-reverse baffle plastics pad 47, all said water drain ports 44 on each sector of said water drain base 41 and said piston head pushing chunk 30 on said diaphragm sheet 20 (as shown in the FIG. 3); besides, one end of each said water inlet chamber 100 is connected with each said water inlet port 45.

Furthermore, some perforated holes 51 and a water inlet orifice 52 as well as a water outlet orifice 53 are created on the outer surface of said pump cover body 50 (as shown in the FIG. 1 and FIG. 3), which also having a ladder groove 54 and an annular groove 55 built inside; said ladder groove 54 is created at the bottom peripheral of said pump cover body 50 so that to closely contact with the outer peripheral of the assembly of said diaphragm sheet 20 and said piston valve body 40; said annular groove 55 is created in the internal center with bottom tightly press on the outer peripheral surface of said water drain base 41 on said piston valve body 40 so that a high pressure water chamber 200 is surrounded by space between the internal wall of said annular groove 55 and said water drain base 41 of said piston valve body 40 (as shown in the FIG. 3).

Please refer to FIG. 4 and FIG. 5, the illustration shown is the operation way of conventional pressurized pumps of diaphragm type mentioned above. When tap-water flows into the water inlet orifice 52 on the pump cover body 50, the tap-water will push the flare piston sheet 46 on the piston valve body 40 open and flows into the water inlet chamber 100 via the water inlet port 45 on the piston valve body 40 (as shown by the arrow head in the FIG. 4); Upon all the wobble plates 13 being orderly driven by the output shaft of the motor 10, the piston head pushing chunk 30 on each said wobble plates 13 will be meanwhile brought to axial reciprocating motion, so that each piston acting region 23 on the diaphragm sheet 20 will simultaneously vibrate in displacement to squeeze the water in the water inlet chamber 100 to let water pressure increase up to 80 psi~100 psi; The high pressure water Wp will push the anti-reverse baffle plastics pad 47 on the water drain base 41 open and constantly flow into the high pressure water chamber 200 via each said water drain port 44 on said water drain base 41, then drain out of the pressurized pump via each water outlet orifice 53 on the pump cover body 50 (as shown by the arrow head of the FIG. 5) in order to provide the water pressure necessary for reverse osmosis by the RO membrane cartridge RO in the RO filter apparatus.

However, there is a common serious drawback in all the disclosed conventional pressurized pump of diaphragm type aforesaid as shown in the figures of 6 through 9. During the process of increasing water pressure after the start of the motor 10, each wobble plate 13 is tightly contacting with the diaphragm sheet 20 closely; hence, said diaphragm sheet 20 between said piston acting region 23 and wobble plate 13 will be pulled to stretch once when each time said wobble plate 13 moves in reciprocating motion to drive said piston acting region 23 on said diaphragm sheet 20 (as shown by the hypothetical line in the FIG. 8); thereby, said diaphragm sheet 20 will be pulled to stretch for 700 times in one minute if rotational speed is 700 rpm; thus, said diaphragm sheet 20 will loosely contact with said piston head pushing chunk 30 without hermetical seal due to long time and high frequent stretch (as shown in the FIG. 9); Consequently, the high pressure water Wp will leak and seep along the gap between the fixing screw 3 and the threaded hole 14 on each said wobble plate 13 and result in total disable and damage of the whole pressurized pump of diaphragm type in consequence of electric short circuit of said motor 10; Under the circumstance of such drawback having no effective solution so far in the manufacturing industry, the consumer has no choice in betting his own luck to buy a target pressurized pump with uncertain service lifetime; If he is unlucky to have motor 10 burnt out due to leakage, the result on fire is un-neglectful.

Moreover, except the aforesaid vital drawback, the other problematical position often leaking is between the piston valve body 40 and the pump cover body 50 as shown in the FIG. 10. When the piston acting region 23 on the diaphragm sheet 20 is constantly pushed and squeezed by the wobble plate 13, the top outer peripheral surface of the piston valve body 40 will constantly strike against and pull off the wall of the ladder groove 54 on the pump cover body 50 (as shown by the black arrow head in the FIG. 10); owing to both of said piston valve body 40 and pump cover body 50 being rigid body without any buffer structure contrivance, the gap will be easily created in between of which after long time of repeatedly strike against and pull off each other; Under high pressure action of water, the water will leak and seep out of the pressurized pump of diaphragm type via the gap between the wall of said ladder groove 54 on said pump cover body 50 and the top outer peripheral surface of said piston valve body 40; Thus, the total effect of increasing water pressure is reduced due to loss in this partial pressure.

SUMMARY OF THE INVENTION

The main object of the present invention is to provide a method and structure of preventing water from leakage for the pressurized pump of diaphragm type with steps orderly comprises: corresponding to the threaded hole on each wobble plate, a hollow cylinder is first contrived on the top surface of each piston acting region of the diaphragm sheet; after sleeving the ladder hole of the piston head pushing chunk on the diaphragm sheet onto the peripheral of said hollow cylinder; drive the fixing screw via the center hole of said hollow cylinder into the threaded hole on each wobble plate of the pressurized pump of diaphragm type; and in the beginning of driving said fixing screw, the upper portion of said hollow cylinder will expand first; after thoroughly and tightly driving said fixing screw into the threaded hole on each wobble plate, the upper portion of said hollow cylinder will expanding deform and fill up the space between the bottom surface of the head of said fixing screw and the top surface of said ladder hole of said piston head pushing chunk; Thus, the function of said hollow cylinder becomes a blocking contrivance in preventing the water from leaking and seeping into the motor and avoiding the damage of pressurized pump of diaphragm type due to electric short circuit of the motor.

The other object of the present invention for providing a method and structure of preventing water from leakage for the pressurized pump of diaphragm type even more contrives an elastic soft washer between the outer peripheral of said piston valve body and the wall of said ladder groove on said pump cover body such that becoming a buffer region so as not only to reduce the rigid striking force and noise by said pump cover body and piston valve body, but also to achieve the effect in hermetical seal in preventing pressure loss and water leakage out of the pressurized pump.

DETAILED DESCRIPTION OF THE PREFERRED EMBODIMENTS

Figure 1:
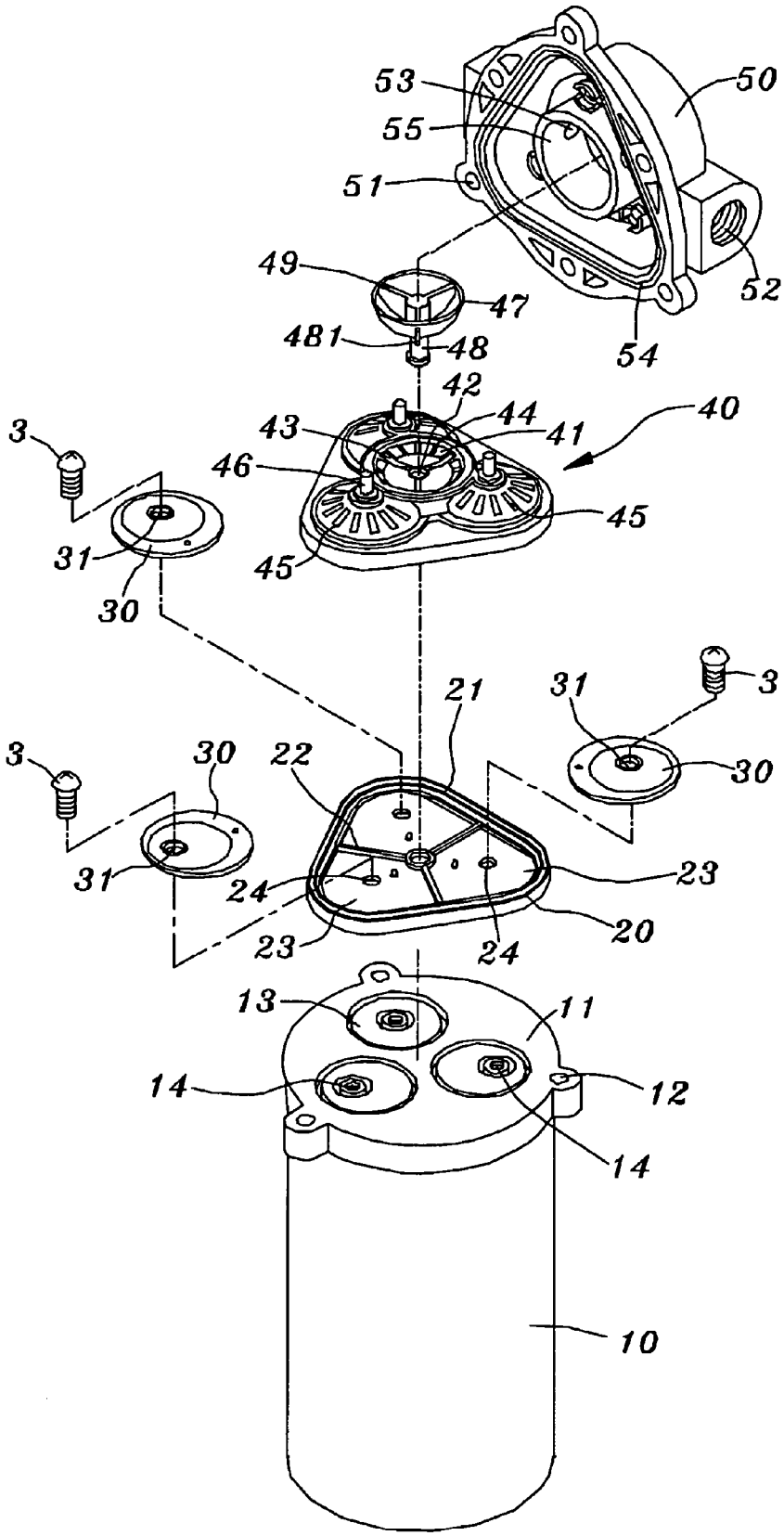
FIG. 1 (PRIOR ART)
FIG. 1 is the perspective exploded view in the conventional pressurized pump of diaphragm type.
Figure 2:
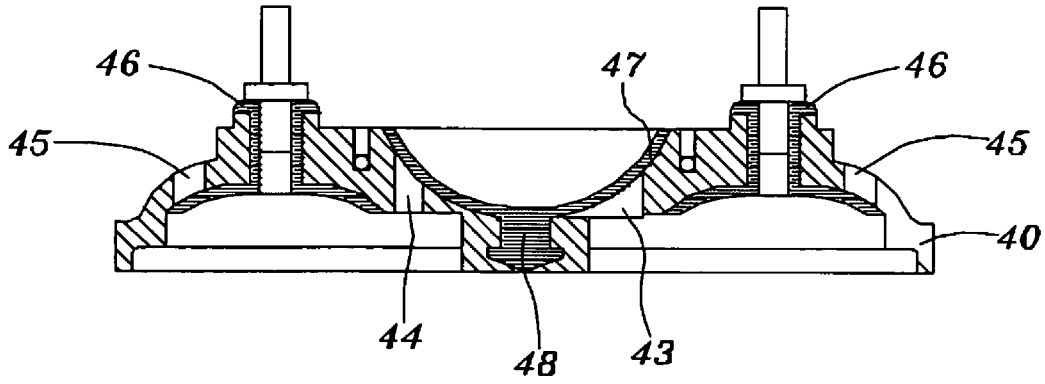
FIG.2(PRIOR ART)
FIG. 2 is the cross-section illustrative view of the conventional piston valve body in the FIG. 1.
Figure 3:
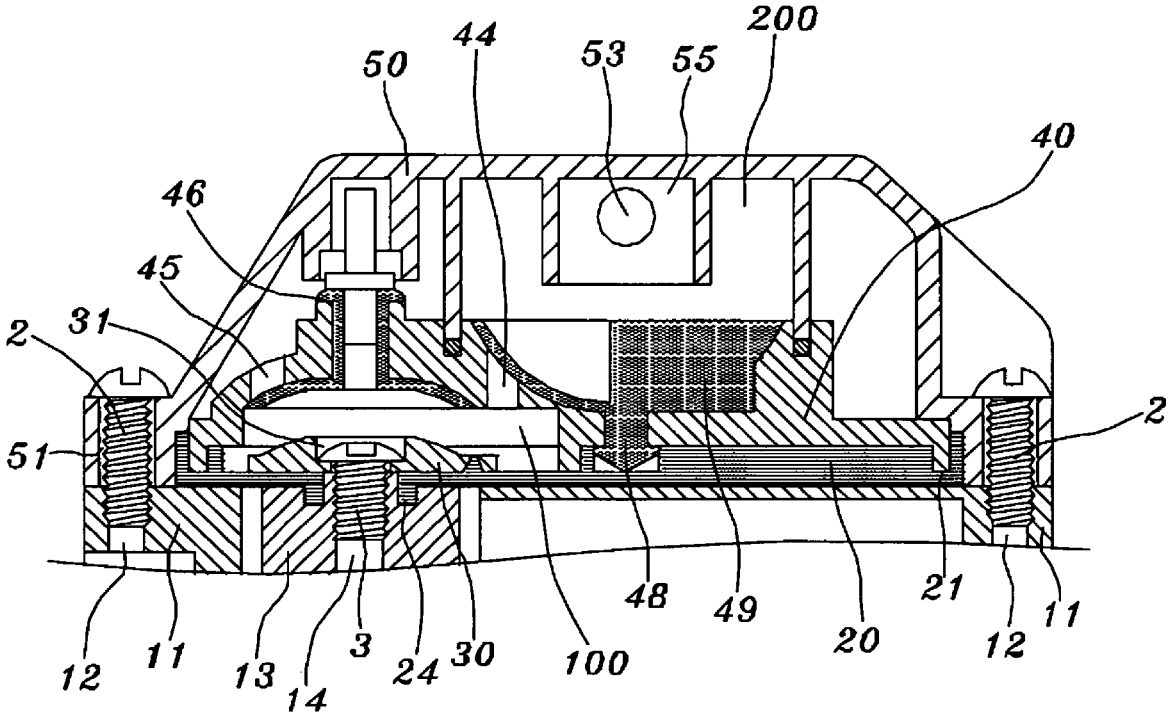
FIG.3(PRIOR ART)
FIG. 3 is the illustrative view showing the internal cross-section of the pump cover body in the conventional pressurized pump of diaphragm type.
Figure 4:
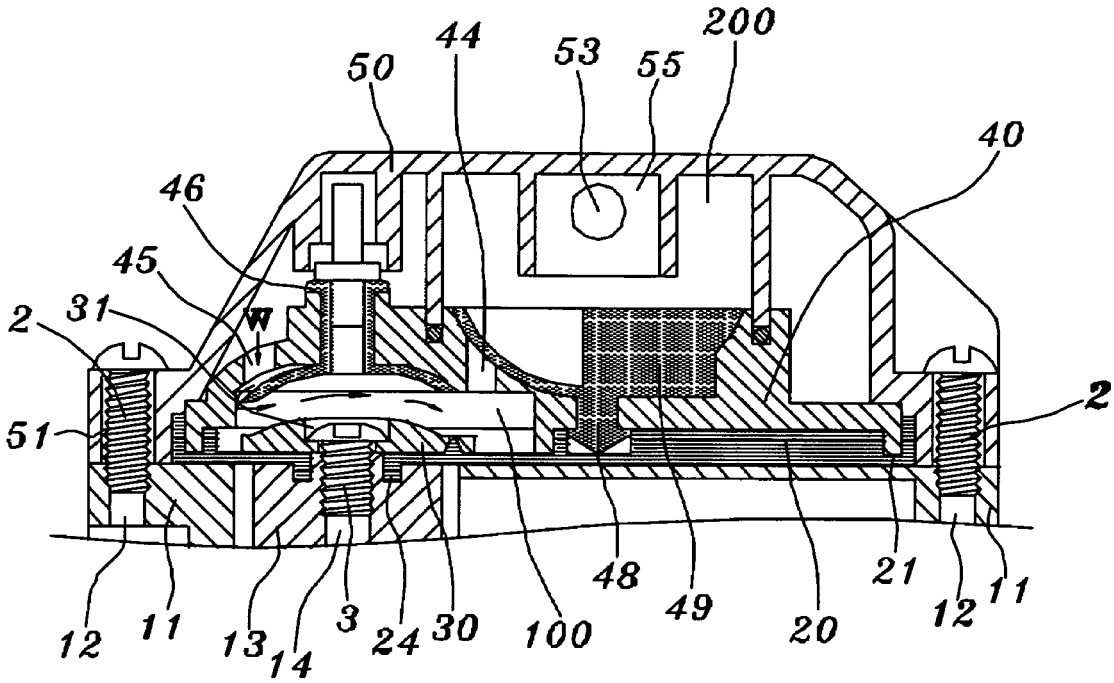
FIG. 4(PRIOR ART)
FIG. 4 is the first operation illustrative view in the conventional pressurized pump of diaphragm type.
Figure 5:
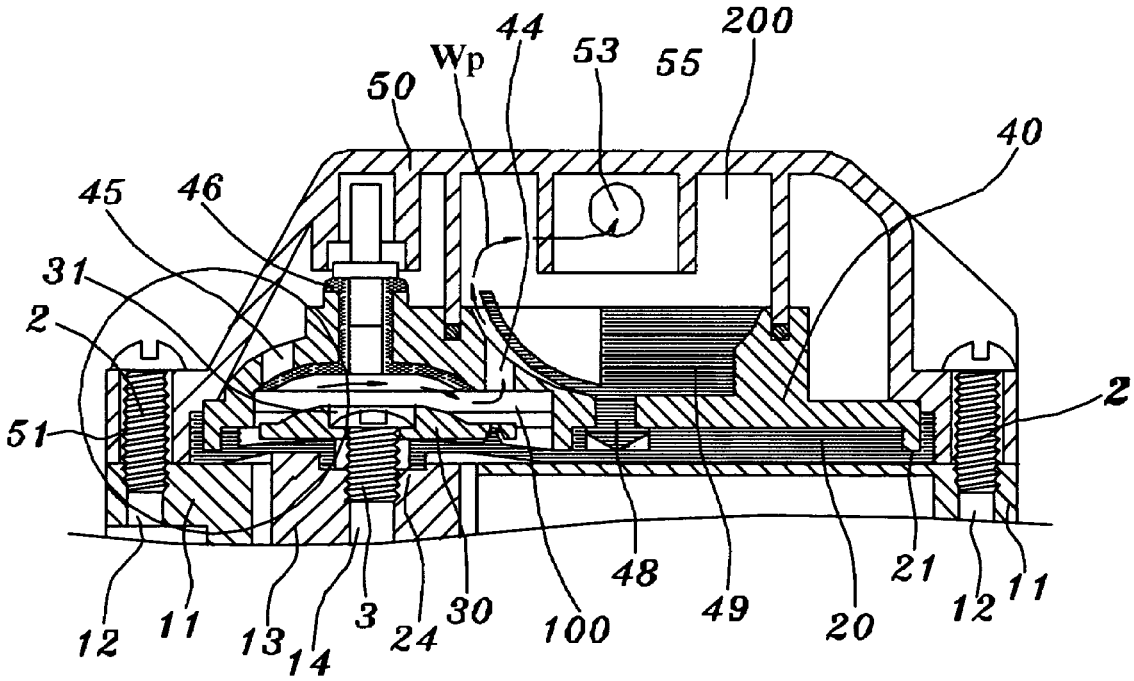
FIG. 5(PRIOR ART)
FIG. 5 is the second operation illustrative view in the conventional pressurized pump of diaphragm type.
Figure 6:
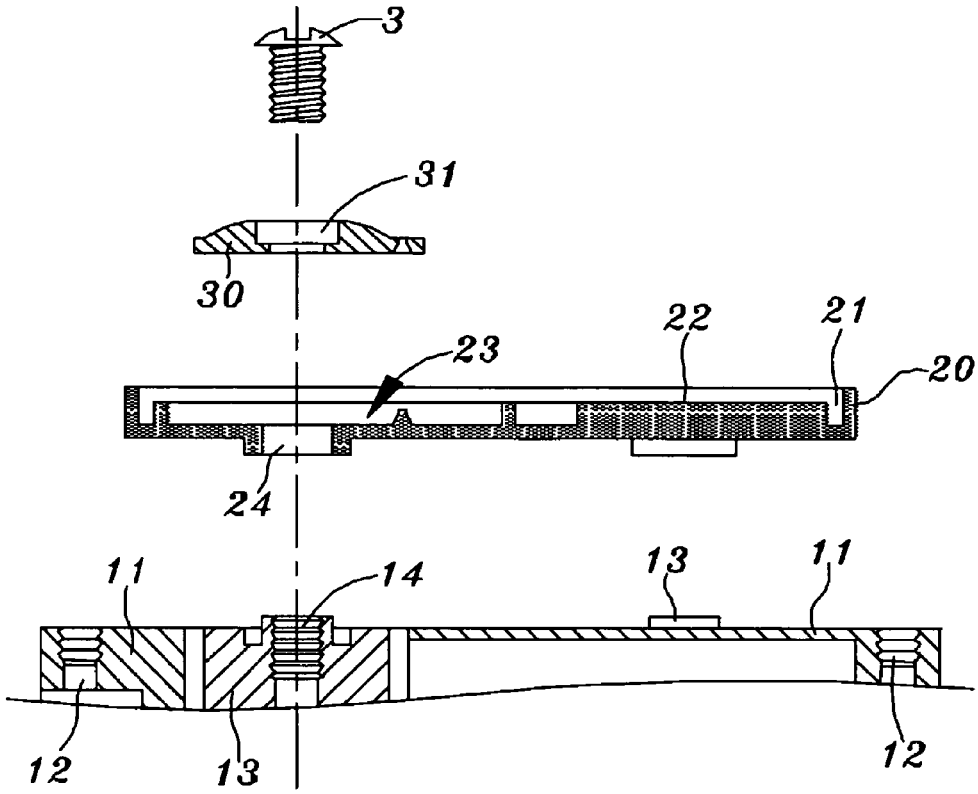
FIG. 6(PRIOR ART)
FIG. 6 is the exploded illustrative view showing the piston head pushing chunk with diaphragm sheet and the wobble plate in the conventional pressurized pump of diaphragm type.
Figure 7:
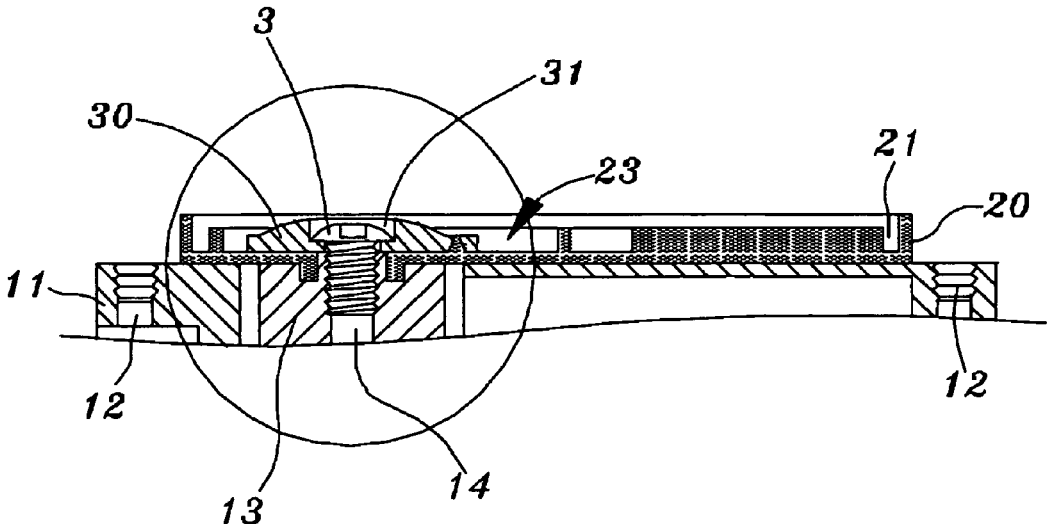
FIG. 7(PRIOR ART)
FIG. 7 is the cross-section view of the assembly in the FIG. 6.
Figure 8:
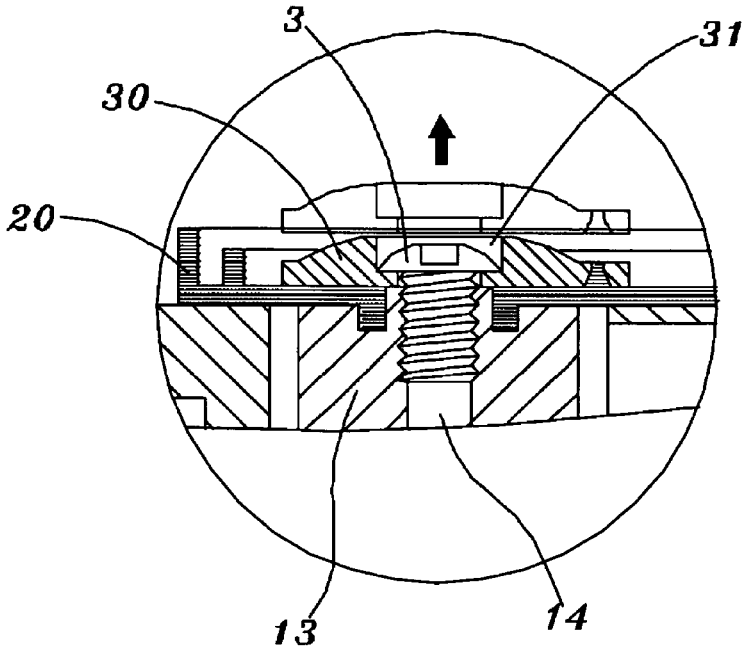
FIG. 8(PRIOR ART)
FIG. 8 is the amplified illustrative view for the partial cross-section of the FIG. 7.
Figure 9:
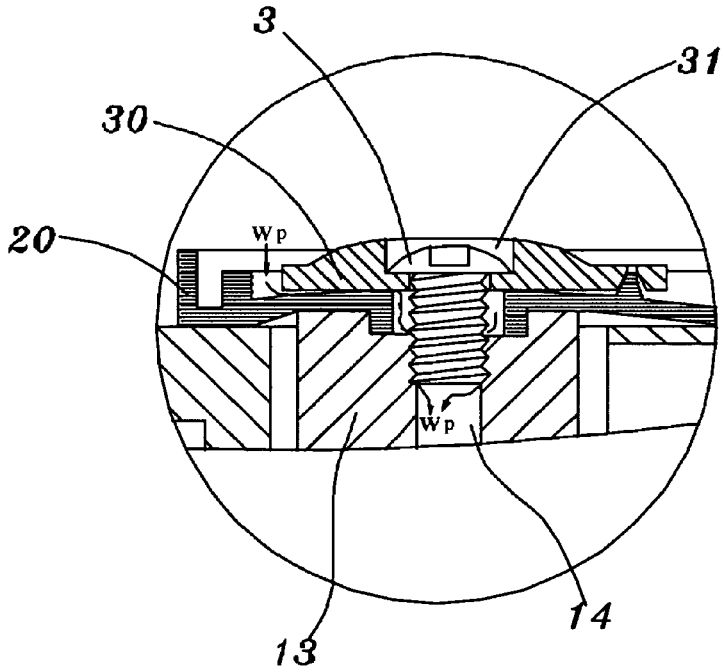
FIG. 9(PRIOR ART)
FIG. 9 is the operation illustrative view of the FIG. 8.
Figure 10:
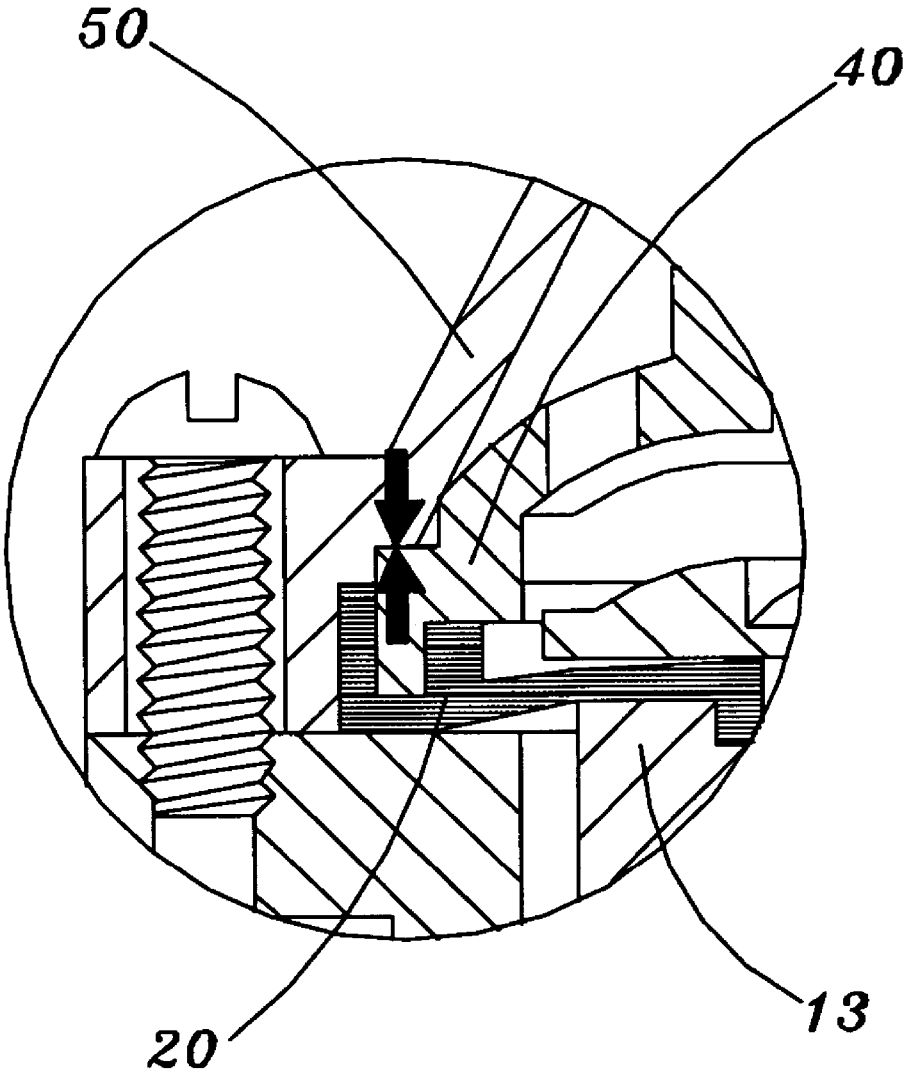
FIG. 10(PRIOR ART)
FIG. 10 is the amplified illustrative view for the partial cross-section of the FIG. 5.
Figure 11:
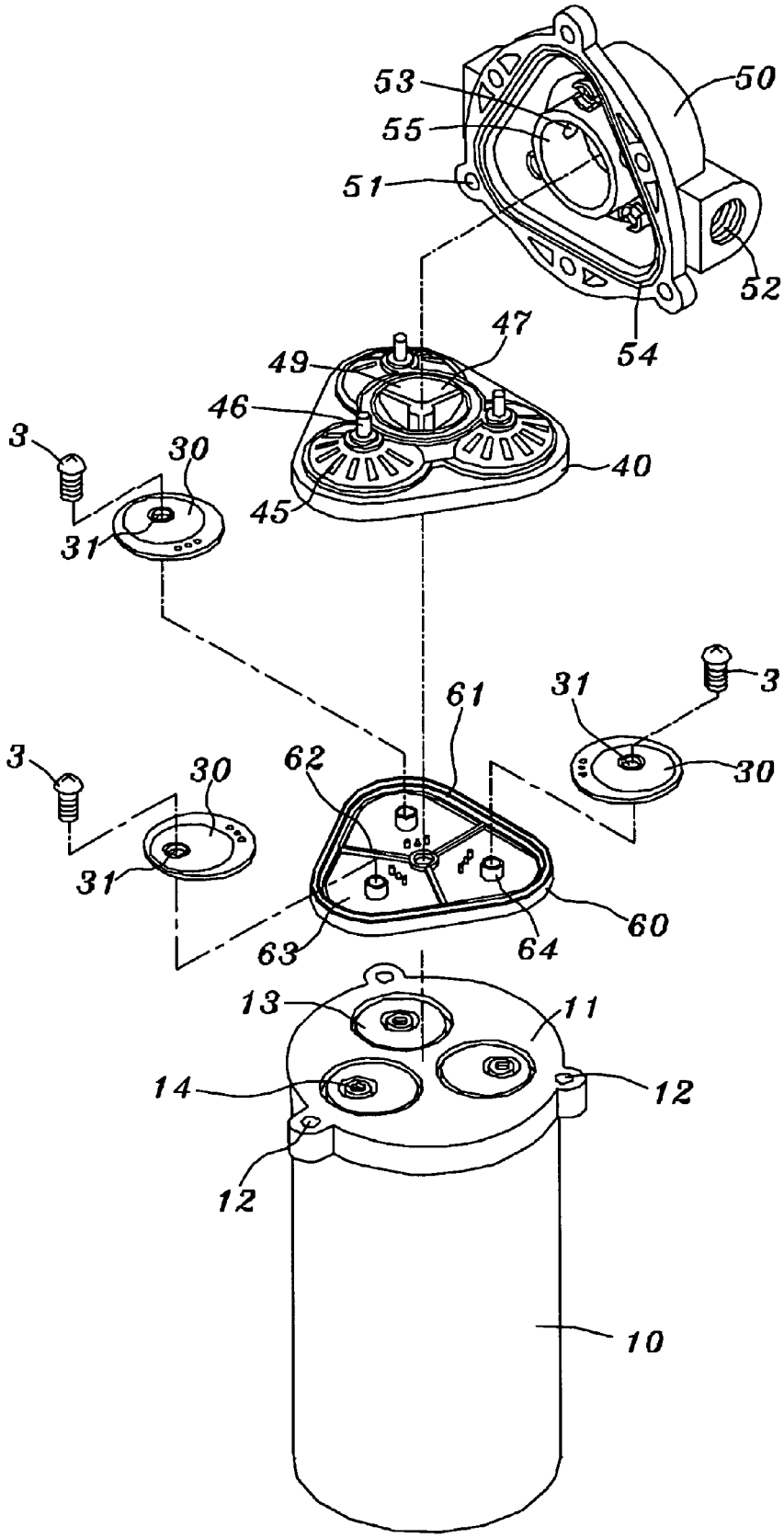
FIG. 11 is the first perspective illustrative view of the present invention.
Figure 12:
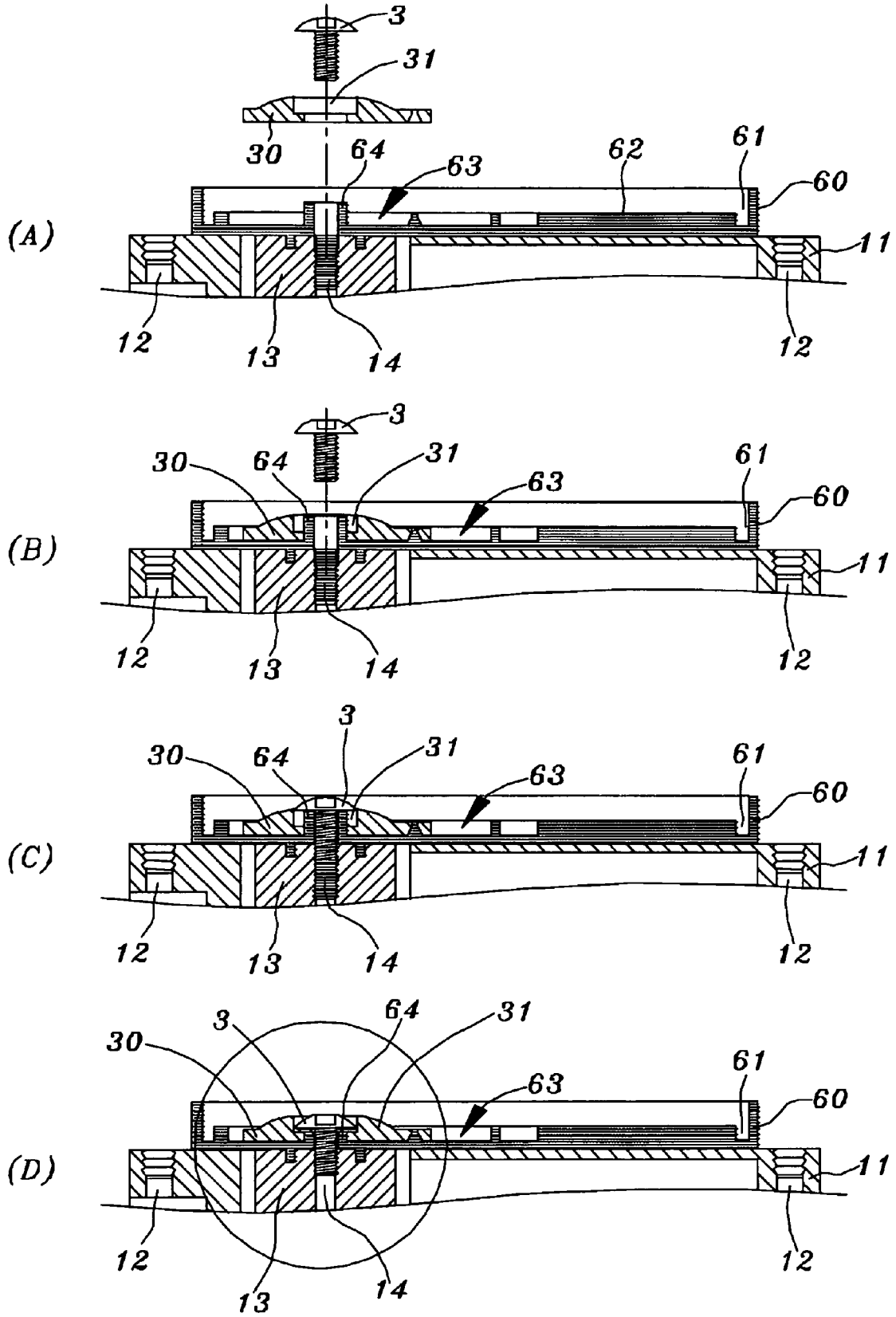
FIG. 12 is the illustrative view for the embodiment steps of the present invention.
Figure 13:
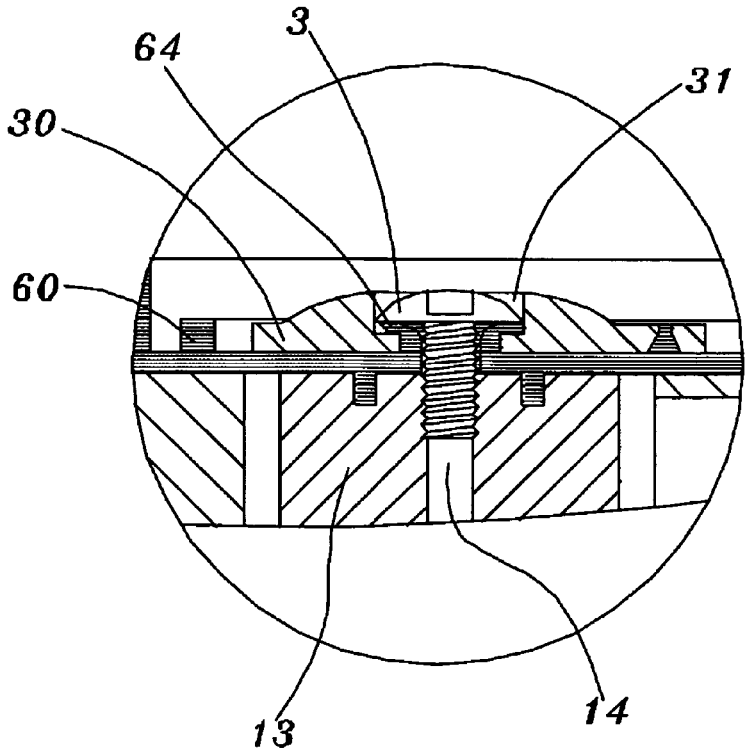
FIG. 13 is the amplified illustrative view for the partial cross-section of the FIG. 12.

Please refer to the figures of 11 through 13 shown as the present invention of The method and structure of preventing water from leakage for the pressurized pump of diaphragm type. Corresponding to the threaded hole 14 on each wobble plate 13, a hollow cylinder 64 is first contrived on the top surface of each piston acting region 63 of the diaphragm sheet 60 such that its outer diameter is equivalent to or slightly smaller than the internal diameter of the ladder hole 31 on the piston head pushing chunk 30; and both of said hollow cylinder 64 and diaphragm sheet 60 are made of same elastic plastics material in extruded unitary molded body (as shown in the FIG. 11 and A view of the FIG. 12); after sleeving said ladder hole 31 of said piston head pushing chunk 30 onto the peripheral of said hollow cylinder 64 (as shown in B view of the FIG. 12), drive the fixing screw 3 via the center hole of said hollow cylinder 64 (as shown in C view of the FIG. 12)

into the threaded hole 14 on each wobble plate 13; In the beginning of driving said fixing screw 3, the upper portion of said hollow cylinder 64 will expand first; after thoroughly and tightly driving said fixing screw 3 into the threaded hole 14 on each wobble plate 13, the upper portion of said hollow cylinder 64 will expanding deform and fill up the space between the bottom surface of the head of said fixing screw 3 and the top surface of said ladder hole 31 of said piston head pushing chunk 30 (as shown in D view of the FIG. 12 and in the FIG. 13); Thus, the function of said hollow cylinder 64 becomes a blocking contrivance in preventing the water from leakage.

Figure 14:
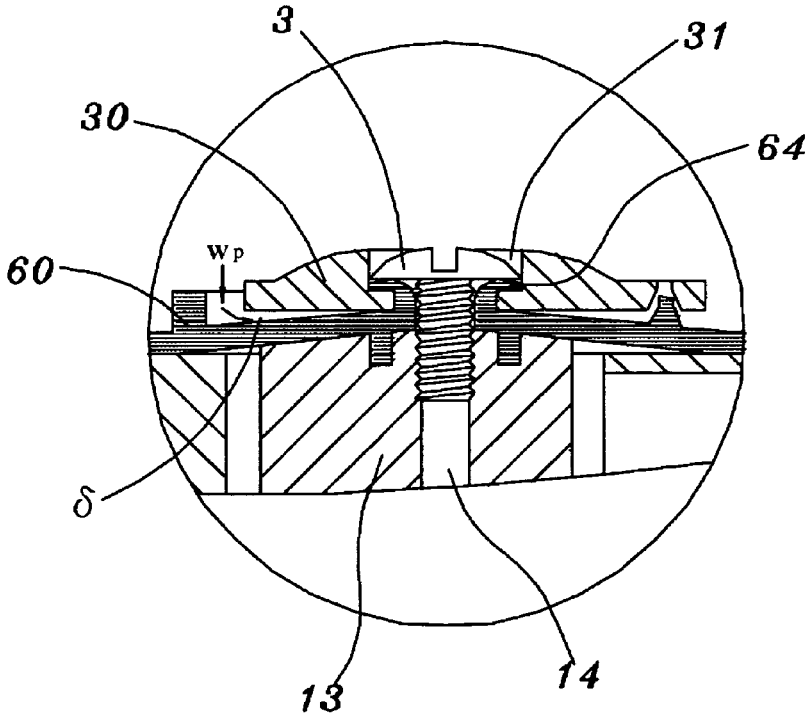
FIG. 14 is the operation illustrative view of the FIG. 13.
Figure 15:
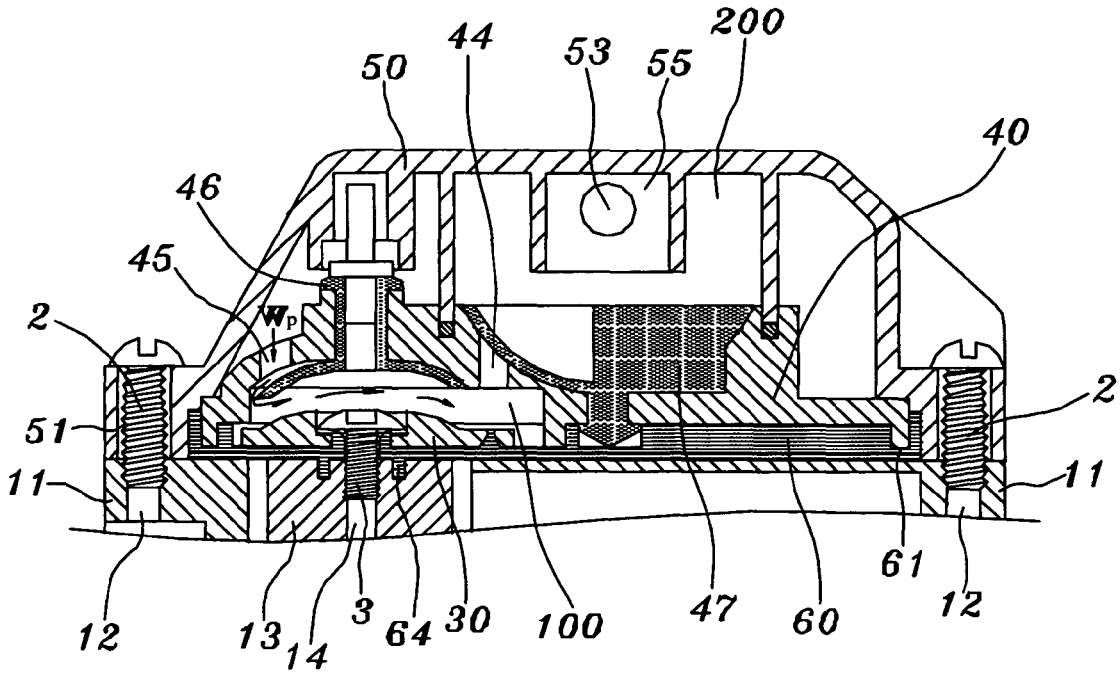
FIG. 15 is the first operation illustrative view of the present invention.
Figure 16:
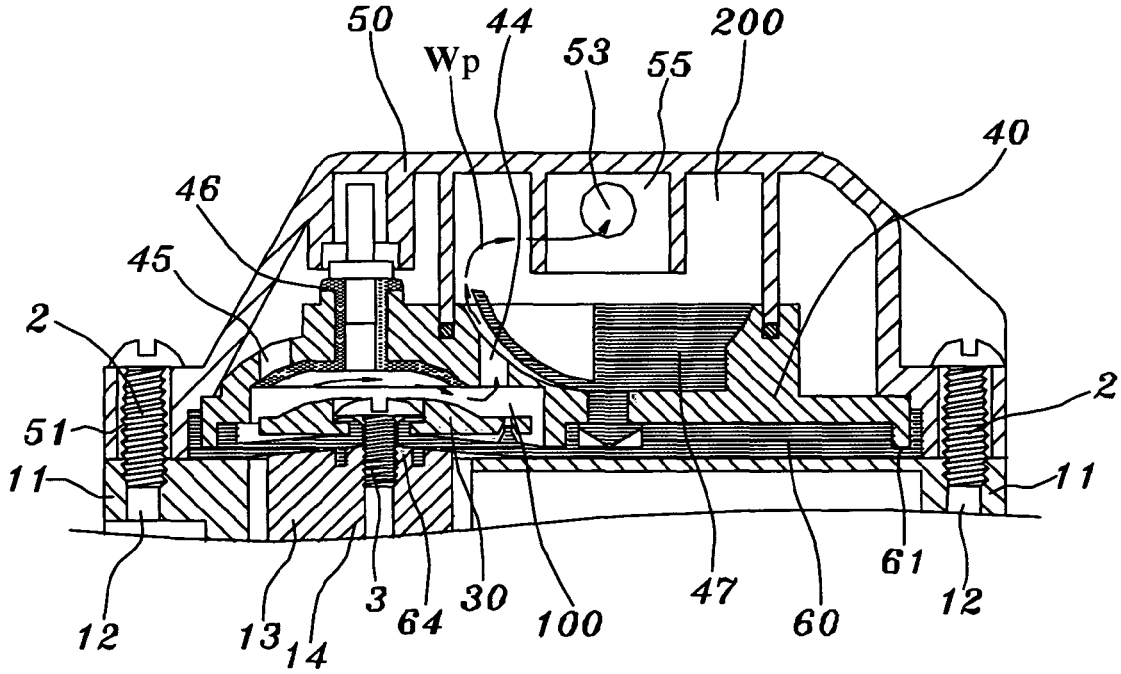
FIG. 16 is the second operation illustrative view of the present invention.
Figure 17:
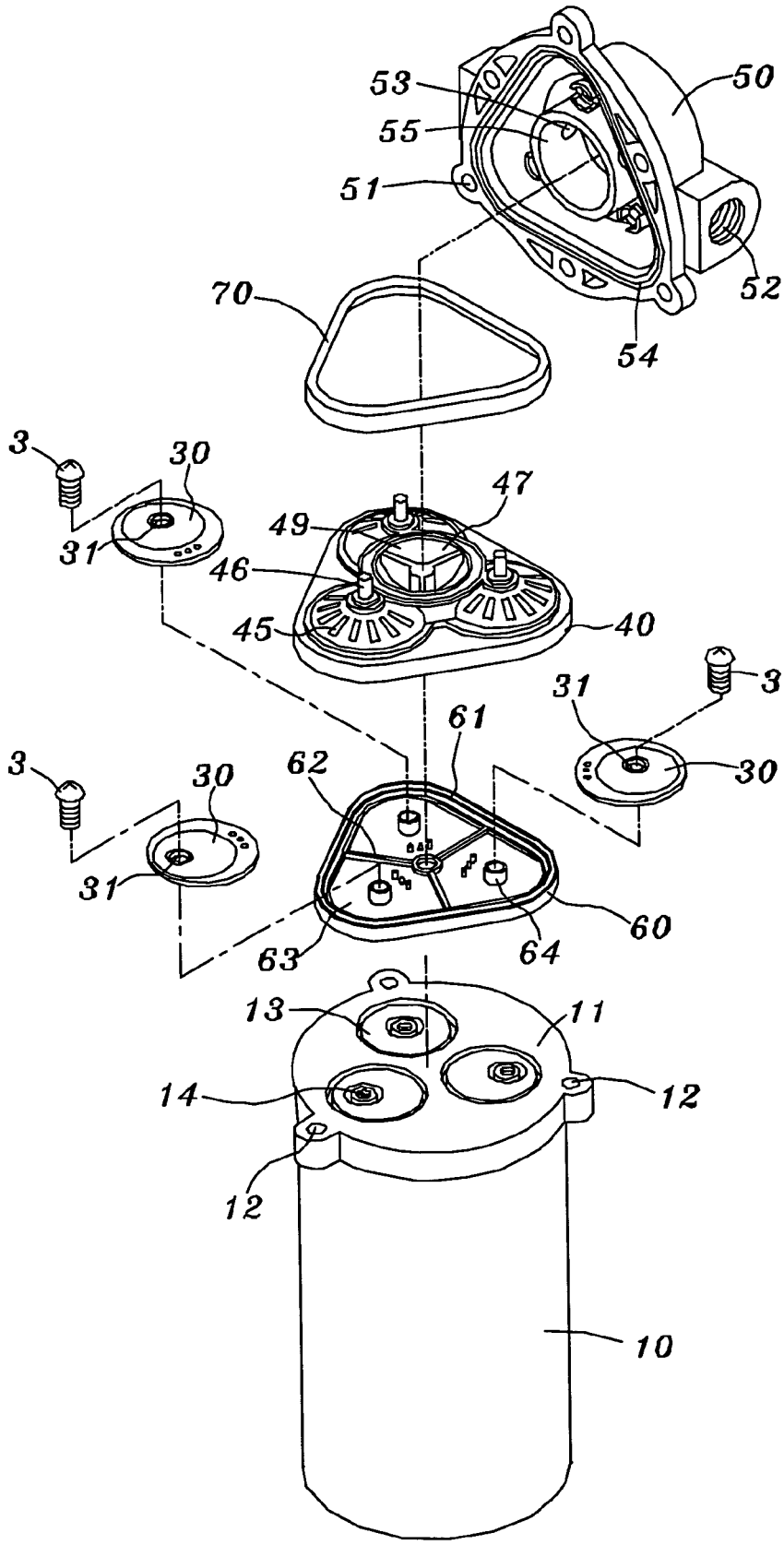
FIG. 17 is the second perspective illustrative view of the present invention.
Figure 18:
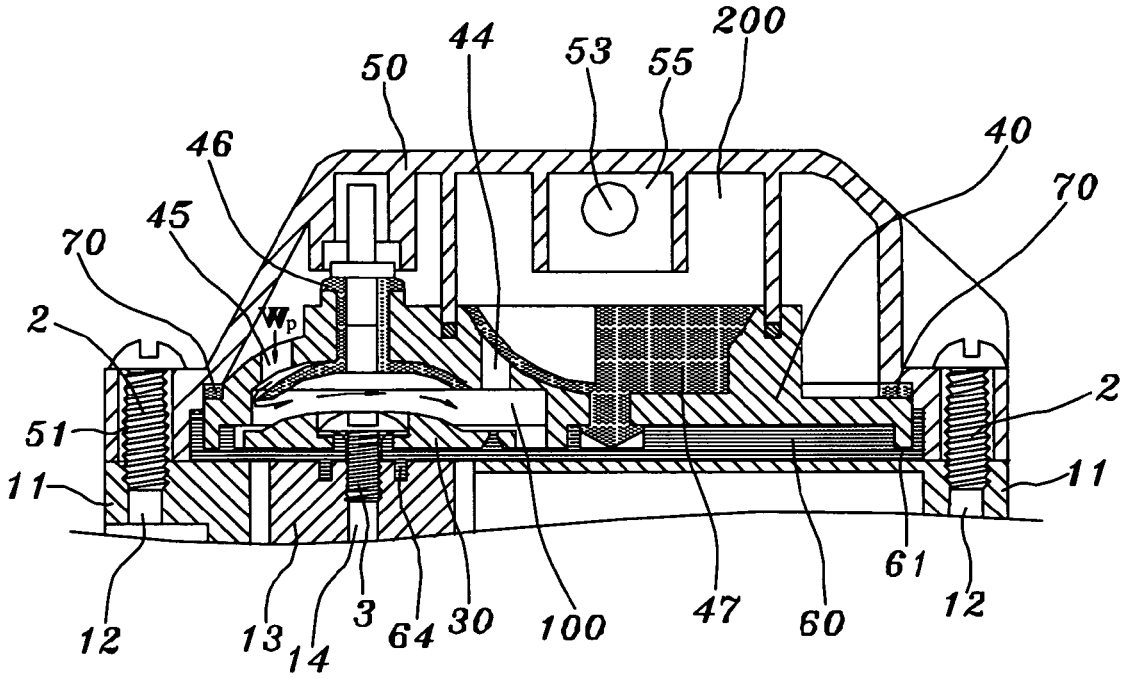
FIG. 18 is the first operation illustrative view in the other exemplary embodiment of the present invention.
Figure 19:
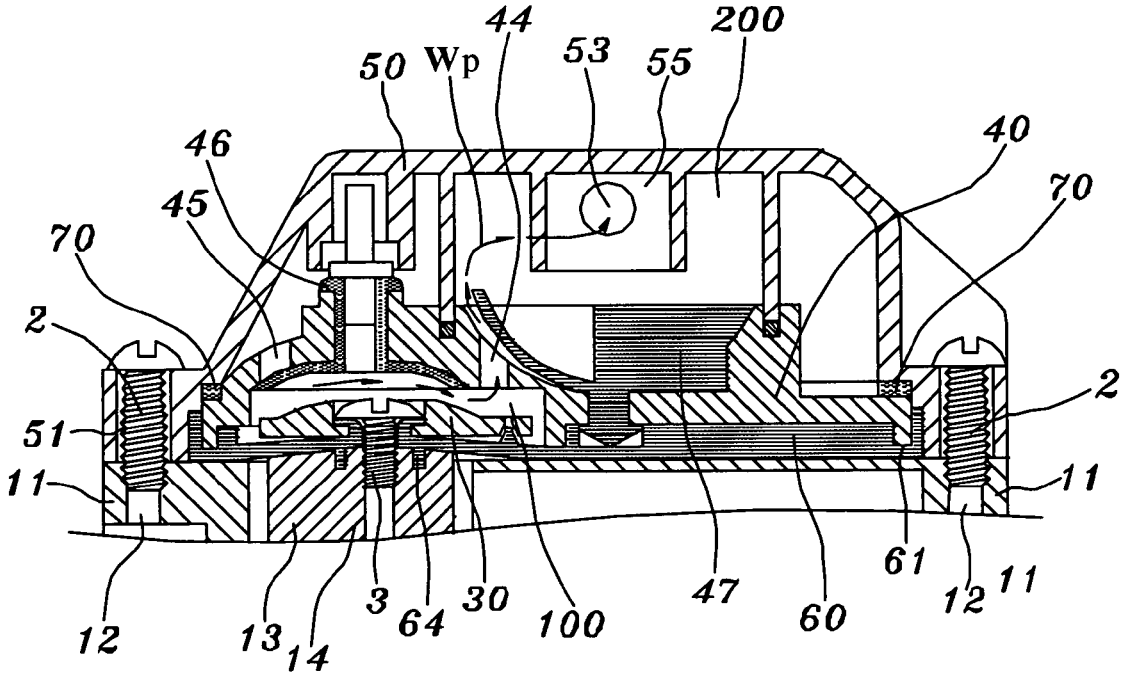
FIG. 19 is the second operation illustrative view in the other exemplary embodiment of the present invention.

Please further refer to the figures of 14 through 16, when said wobble plate 13 acting in push and squeeze the feed water W (as shown in the FIG. 16), the diaphragm sheet 20 of the piston acting region 23 will be pushed to displacement simultaneously so that a gap δ is created between the bottom surface of said piston head pushing chunk 30 and the top surface of said diaphragm sheet 20 (as shown in the FIG. 14); By means of surrounding block function of expansion deformation on the upper portion of said hollow cylinder 64, the leakage and seeping of water along the gap between said fixing screw 3 and said threaded hole 14 on each said wobble plate 13 can be avoided; thus, it achieves the effect in preventing the damage of the pressurized pump from electric short circuit in the motor 10 due to the high pressure water Wp leaking and seeping into the motor 10.

Please also further refer to the figures of 17 through 19, the present invention even more contrives an elastic soft washer 70 between the outer peripheral of said piston valve body 40 and the wall of said ladder groove 54 on said pump cover body 50 such that becoming a buffer region so as not only to reduce the rigid striking force and noise by said pump cover body 50 and piston valve body 40, but also to achieve the effect in hermetical seal in preventing pressure loss and water leakage out of the pressurized pump.

In conclusion, the present invention contrives the hollow cylinder 64 to replace the central perforated hole 24 of the piston acting region 23/63 on the diaphragm sheet 20/60, and employs the same original assemble steps to form the leakage-resistant structure; Therefore, it is really an innovative invention with industrial application value owing to not only eliminating any extra expense in manufacturing cost, but also achieving the effect in leakage-resistance.

What is claimed is:

1. A method of preventing water from leaking in a diaphragm type pressurized pump, comprising the steps of:

providing a motor and a plurality of wobble plates driven by said motor, each wobble plate including a threaded hole formed therein;

providing a diaphragm sheet having a plurality of piston acting regions corresponding respectively to the plurality of wobble plates, each piston acting region including a hollow cylinder formed on a top surface of the piston acting region and corresponding to a respective threaded hole;

disposing a plurality of piston head pushing chunks respectively on the piston acting regions such that a ladder hole formed in each piston head pushing chunk receives a respective hollow cylinder, the hollow cylinders protruding upwardly from the piston head pushing chunks, each ladder hole having a flange member formed at a bottom portion of the ladder hole;

driving a fixing screw through the ladder hole in each piston head pushing chunk and a center hole in each hollow cylinder such that the fixing screw engages the threaded hole in the wobble plate;

causing the hollow cylinder to deform as the fixing screw in driven such that an upper portion of the hollow cylinder is sandwiched between a bottom surface of a head of the fixing screw and the flange member of the ladder hole to seal the threaded hole from water.

2. The method as claim in claim 1, wherein the hollow cylinder and the diaphragm sheet are made of an extruded unitary molded body of an elastic plastic material, and an outer diameter of the hollow cylinder is equivalent to or smaller than an internal diameter of the ladder hole.

* * * * *